United States Patent [19]

Kendall et al.

[11] Patent Number: 4,664,620

[45] Date of Patent: May 12, 1987

[54] HEATER WITH ZONE-CONTROLLED RADIANT BURNERS

[75] Inventors: Robert M. Kendall, Sunnyvale; Richard J. Schreiber, San Jose; Andrew C. Minden, La Honda; Thomas Wong, Menlo Park, all of Calif.

[73] Assignee: Gas Research Institute, Chicago, Ill.

[21] Appl. No.: 828,039

[22] Filed: Feb. 10, 1986

[51] Int. Cl.[4] ..... F23D 14/12

[52] U.S. Cl. ..... 431/328; 431/7; 126/92 AC; 126/92 C; 126/92 R

[58] Field of Search ..... 431/7, 12, 170, 278, 431/285, 328, 329, 326, 174; 126/92 R, 92 AC, 92 B, 92 C, 109; 122/356, 240, 367 R

[56] References Cited

U.S. PATENT DOCUMENTS

| | | | |
|---|---|---|---|
| 2,182,586 | 12/1939 | Heid | 122/356 |
| 2,346,348 | 4/1944 | Barnes | 122/356 |
| 2,527,410 | 10/1950 | Fleischer | 122/356 |
| 3,045,230 | 12/1969 | Harrington | 431/329 |
| 3,105,467 | 10/1963 | Griffith | 122/356 |
| 3,110,300 | 11/1963 | Brown | 126/109 |
| 3,169,752 | 2/1965 | Constance | 126/92 R |
| 3,200,874 | 8/1965 | Koppel | 431/328 |
| 3,291,104 | 12/1966 | Zimmerman | 122/240 |
| 3,336,915 | 8/1967 | Fannon et al. | 126/92 AC |
| 3,384,052 | 5/1968 | Zimmerman | 122/356 |
| 3,425,675 | 2/1969 | Twine | 431/328 |
| 3,610,791 | 10/1971 | Zacaccia | 431/329 |
| 3,946,719 | 3/1976 | Bark et al. | 126/92 AC |
| 4,019,466 | 4/1977 | Reed | 122/367 R |
| 4,035,132 | 7/1977 | Smith | 431/7 |
| 4,039,275 | 8/1977 | McGettrick | 431/329 |
| 4,272,237 | 6/1981 | Smith | 431/328 |
| 4,290,746 | 9/1981 | Smith | 431/328 |
| 4,354,823 | 10/1982 | Buehl et al. | 126/92 AC |
| 4,373,904 | 2/1983 | Smith | 431/328 |
| 4,400,152 | 8/1983 | Craig et al. | 431/328 |
| 4,494,485 | 1/1985 | Kendall | 431/328 |
| 4,543,940 | 10/1985 | Krill et al. | 431/328 |

FOREIGN PATENT DOCUMENTS

| | | | |
|---|---|---|---|
| 1029774 | 5/1966 | United Kingdom | 126/92 B |

*Primary Examiner*—James C. Yeung

*Attorney, Agent, or Firm*—Flehr, Hohbach, Test, Albritton & Herbert

[57] ABSTRACT

Zone-controlled radiant burners are provided for retrofit installation in existing heaters. The burners comprise hollow cylindrical fiber matrix layers with baffles forming separate plena. A main stream of pre-mixed fuel and air is directed into the middle plenum, with the mixture flowing through the fiber matrix layer and incandescently combusting on the active surface zones to radiantly heat the tube coils. A reduced flow of fuel/air mixture, or only air, is directed into the remaining plenum so that the surrounding surface zones are combustibly less active or inactive to avoid destructive overheating of the burner surfaces.

25 Claims, 13 Drawing Figures

HEATER WITH ZONE-CONTROLLED RADIANT BURNERS

This invention relates to apparatus and processes for heating fluids for use in the petroleum, chemical and related industries. The invention has application in these industries for hydrocarbon heating and petroleum refining such as high-temperature cracking of hydrocarbon gases, thermal polymerization of light hydrocarbons, hydrogenation of oils, and steam generation.

In the petroleum industry natural gas is the largest segment of purchased fuel and supplies one-quarter of the industry's total energy needs. Approximately two-thirds of this natural gas has been employed in refinery heaters. Heretofore these heaters have been both thermally inefficient and a source of considerable $NO_x$ emissions. Conventional heaters are also relatively large in size requiring substantial steelwork which is costly to fabricate and erect.

At present there is a large installed base of process heaters which are fired by conventional burners of the supported flame type. The conventional supported flame burners in these heaters operate with relatively poor thermal uniformity and efficiencies and develop undesirably large amounts of harmful emissions, particularly $NO_x$. The need has been recognized to improve the thermal and emissions performance of existing heaters by retrofitting with more efficient burners and thereby avoid the large costs and downtime that would otherwise be involved in installing a completely new heater system.

Accordingly, it is a principal object of the present invention to provide a new and improved heater for use in the process and related industries which obviates the disadvantages and limitations of existing heaters.

Another object is to provide a heater which is smaller in size and relatively more compact in relation to conventional heaters having comparable heat input ratings.

Another object is to provide a heater of the type described which can be constructed with reduced capital cost and reduced site area requirements as compared to conventional heaters of comparable heat input ratings.

Another object is to provide a new zone-controlled burner for use in heaters of the type described.

Another object is to provide a new zone-controlled radiant burner which provides discrete surface zones which are combustibly active or less active or inactive.

Another object is to provide a zone-controlled radiant burner which is adaptable for retrofit into existing process heaters to improve the heaters' thermal and emissions performance, to operate with substantially no combustion noise and to minimize the problems of coking and burnout of the radiant and convective section tubes.

The invention in summary includes zone-controlled radiant burners adapted for retrofit installation in existing heaters to radiantly heat tube coils which contain the process fluid or water. The burners comprise hollow cylindrical fiber matrix shells which are mounted in closely spaced-apart relationship about nested tube coils. The burners are of either circular or oval cross section and include baffles which divide the burner shells into separate plena. A main stream of premixed fuel-air directed into the middle plena flows outwardly through the matrix and flamelessly combusts on active surface zones to radiantly heat the tube coils. A reduced flow of fuel-air mixture, or only air, is directed into the remaining plena so that the surrounding surface zones are combustibly less active or inactive to avoid destructive overheating of the burner surfaces.

The foregoing and additional objects and features of the invention will appear from the following specification in which the several embodiments have been described in conjunction with the accompanying drawings.

Figure 1:
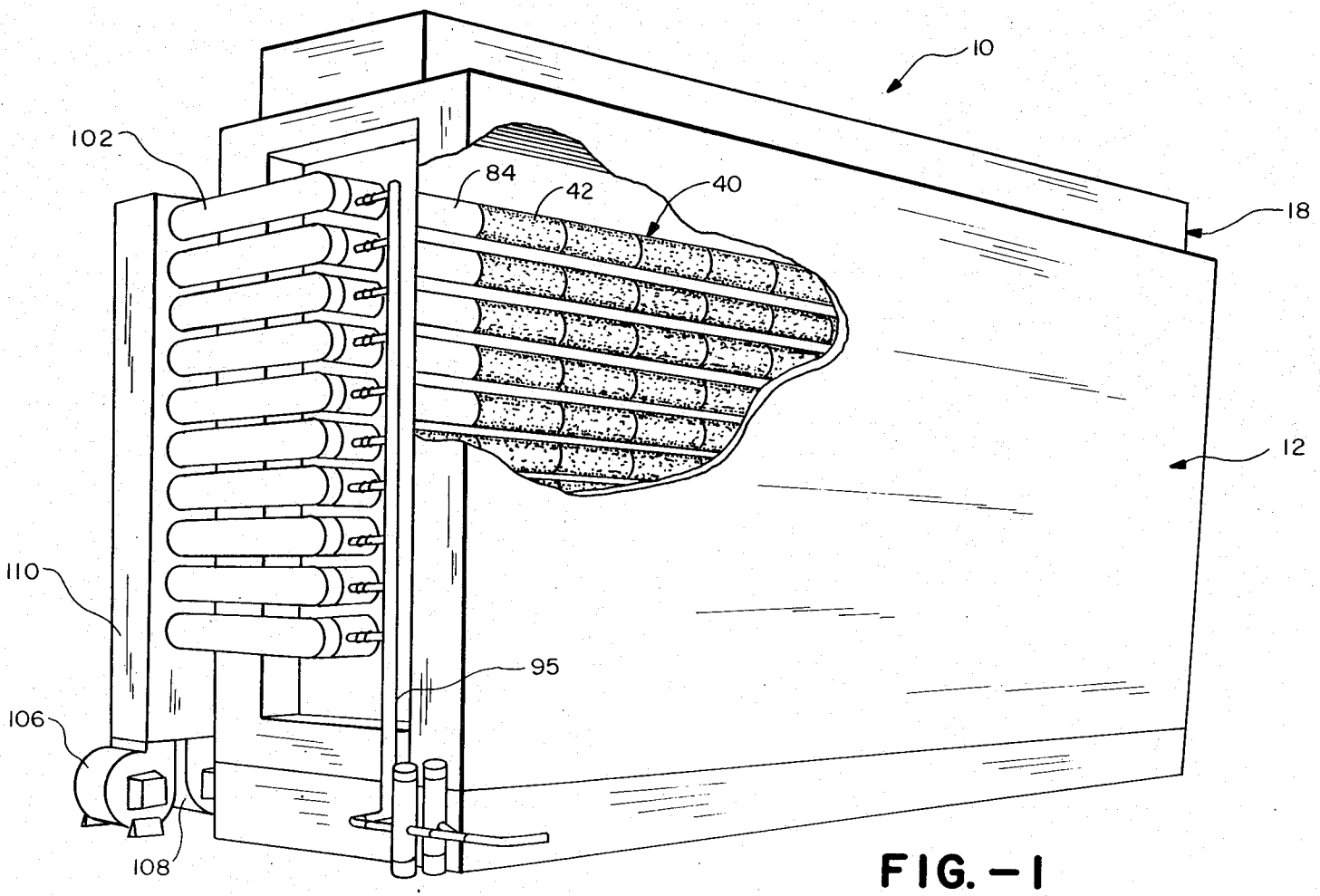
FIG. 1 is a perspective view, partially broken-away, of one embodiment comprising a process heater which has been retrofitted in accordance with the invention.

The drawings illustrate in FIGS. 1–7 one preferred embodiment of the invention comprising a process heater 10 of the box or cabin type which has been retrofitted to incorporate the zone-controlled radiant burners of the invention.

Heater 10 includes a radiant section 12 comprising a horizontal setting of tube coils 14, 16 and a convection section 18 comprising a horizontal setting of tube coils 20, 22 disposed above the radiant section. The tube coils are in a chamber enclosed by heater side walls 24, 26 end walls 28, 30, floor 32 and a roof 34. A flue 36 in the roof directs exhaust gases from the heater to an outlet stack, not shown.

Within heater chamber 38 a pluality of horizontally extending, zone-controlled radiant burner units 40 are mounted in vertical spaced-apart relationship in at least one tier. In the radiant section the tube coils 14, 16 are comprised of closely-spaced interconnected tubes which extend along the inside of the side walls in facing relationship with the burners. In the convection section the tubes in the rows of coils 20, 22 are spaced-apart to permit upward flow of exhaust gases for extraction of residual heat.

Figure 4:
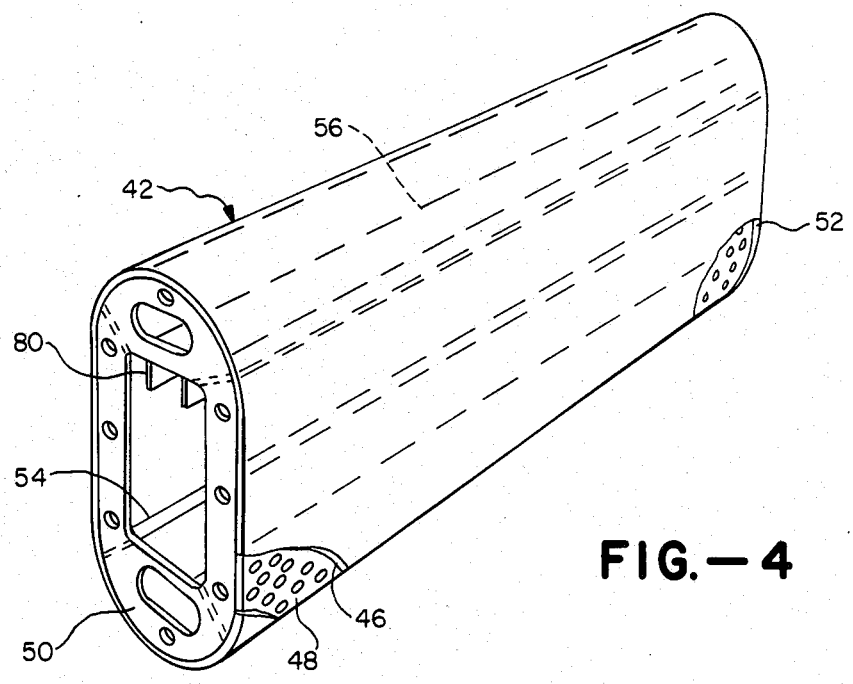
FIG. 4 is a perspective view to an enlarged scale illustrating a typical segment of one of the zone-controlled radiant burners shown in FIGS. 2 and 3.

In the illustrated embodiment ten of the burner units 40 are provided in a single tier, although the number and size of such burner units may vary according to the specification and requirements of a particular application. Each burner unit is comprised of a plurality of burner segments, and the segment 42 illustrated in FIG. 4 is typical. Six of the segments are mounted in tandem on a horizontal support beam 44 to form the elongate cylindrical burner unit 40 in the manner illustrated in FIG. 2. Suitable pilot flames, not shown, are mounted on the floor of the heater chamber to ignite the burners.

Figure 5:
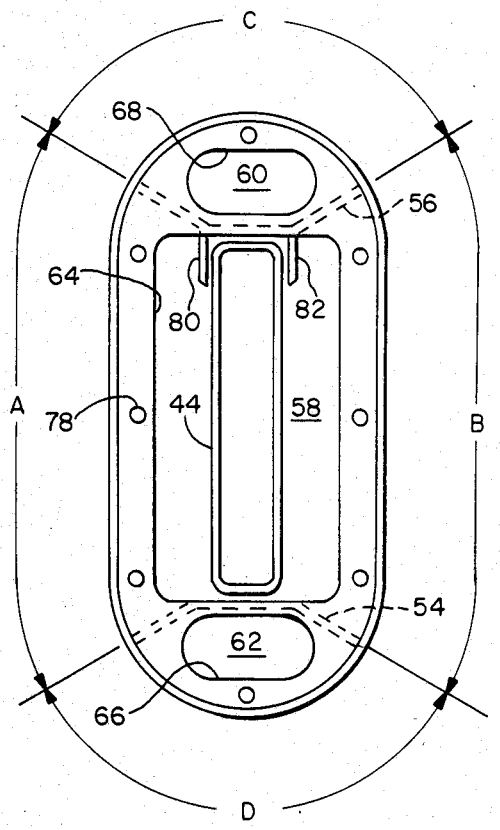
FIG. 5 is a cross sectional view of the burner segment of FIG. 4 showing the segment mounted on a support beam.

FIGS. 4 and 5 illustrate details of the construction of the typical burner segment 42. A fiber matrix shell 46 of elongate cylindrical shape is carried about a perforate support screen 48 which in turn is mounted between a pair of end plates or flanges 50, 52. The cross sectional shape of the shell can be circular or oval, as required. In the process heater of the illustrated embodiment the oval burner shape provides an optimum radiant view to the tube coils with the flat burner sides providing a relatively large radiant surface area in comparison to burners of circular cross section.

Burner shell 46 is comprised of a porous layer of ceramic fibers which flamelessly combusts at its surface premixed gaseous fuel and air. Preferably the composition and method of formulation of the porous layer comprises vacuum-forming the porous layer from a special slurry composition of ceramic fibers, binding agent and filler. The layer is capable of being vacuum-formed into various configurations, including the cylindrical configuration of the burners employed in the present invention. The interface between the edges of the active porous layer and the inactive metal flanges 50, 52 are sealed by a suitable temperature-resistant adhesive composition.

A pair of U-shaped baffles 54, 56 are mounted longitudinally within the inner volume of each burner segment, and the edges of the baffles are secured as by welding to perforate screen 48 and to the end flanges 50, 52. The baffles divide the inner volume into three separate plena which extend lengthwise of the shell. The middle plenum 58 formed between the two baffles is the largest in size and receives the incoming stream of premixed fuel and air which flows outwardly through the interstitial spaces between the fibers, and the mixture flamelessly combusts on the shell's surrounding outer surface which is thereby the active surface zone shown along arcs A and B. The upper plena 60 formed above baffle 56, and the lower plena 62 formed below baffle 54, are adjacent surface zones, shown along arcs C and D, which are combustibly inactive or less active. The upper and lower plena receive incoming gas streams which are comprised either of only air or of a fuel/air mixture at a reduced flow rate relative to the flow rate through the middle plena.

With the gas stream in the upper and lower plena comprising only air the surface zones C and D are rendered inactive. With the gas streams comprising a fuel/air mixture the relative flow rates are controlled so that the combustion activity of the less active surface zone C and D is in the range of substantially 5%–20% of the combustion activity of surface zone A and B. This is achieved by establishing the flow rate of mixture through the fiber layer at zones C and D within the range of 5%–20% of the flow rate through the layer at zones A and B. In either case the inactive or less active surfaces protect the burners from destructive overheating from adjacent burners or from uncooled surfaces inside the heater, such as refractory surfaces. A large port 64 is formed in the middle of each end flange for communicating the air/fuel stream between the middle plena of adjacent burner segments. Smaller size ports 66, 68 are formed at the opposite end of each end flange for providing intercommunication between the plena at the upper and lower ends of adjacent segments.

Figure 2:
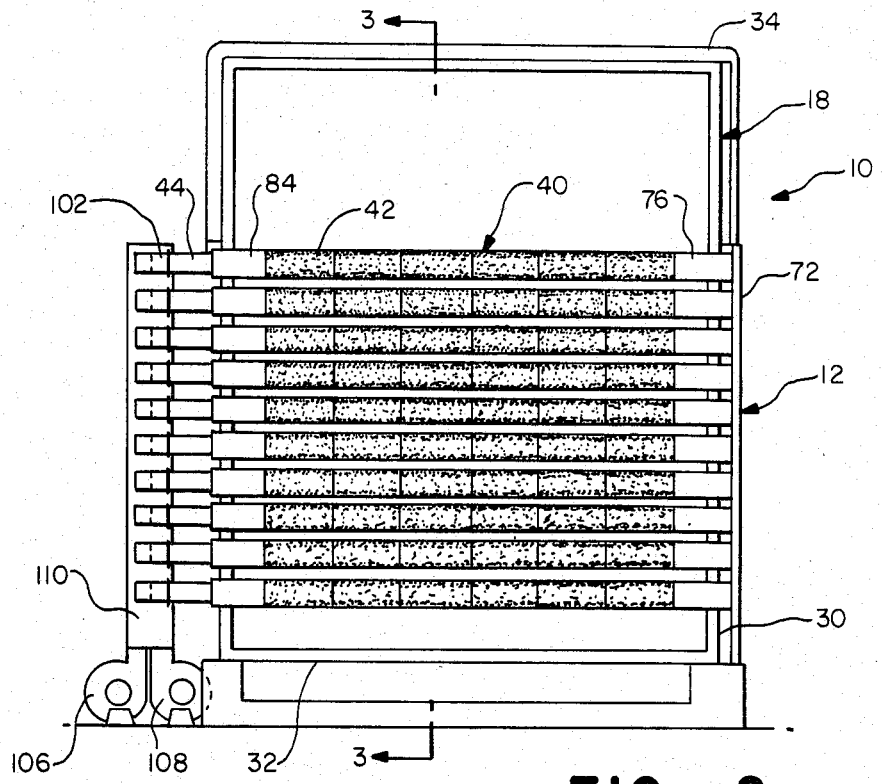
FIG. 2 is a longitudinal section view of the heater of FIG. 1.
Figure 3:
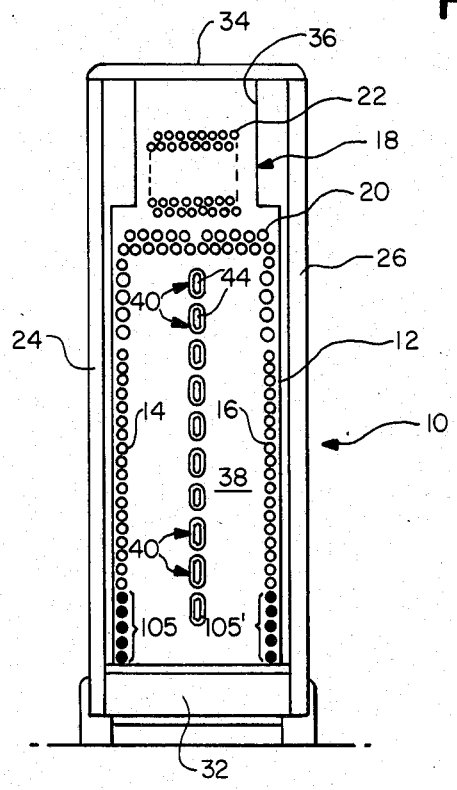
FIG. 3 is a vertical cross sectional view taken along the line 3—3 of FIG. 2.
Figure 6:
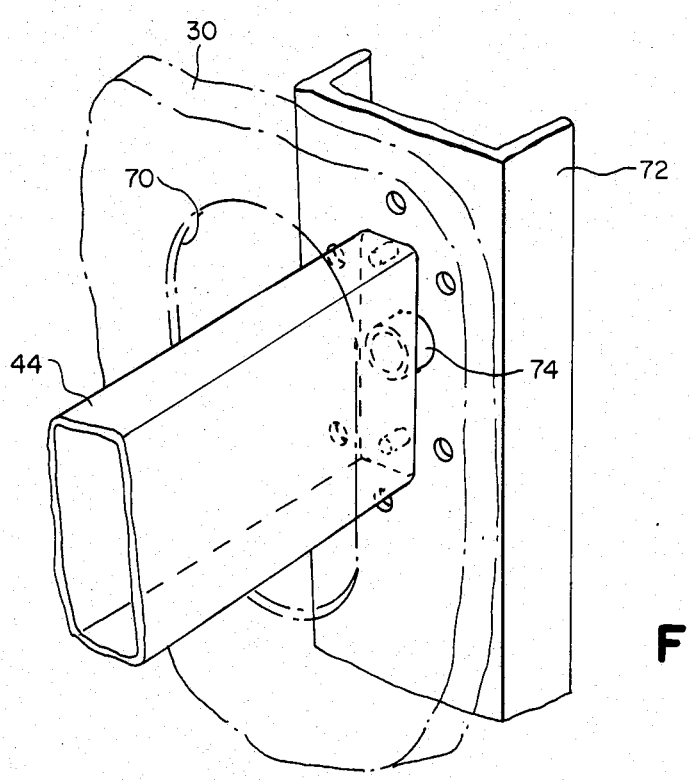
FIG. 6 is a perspective view showing the mounting arrangement for the support beam which carries the burner segment of FIG. 4.

As best shown in FIGS. 2 and 3 the burner units 40 are carried on ten elongate horizontal beams 44 which are mounted in a vertical tier inside the heater. The beams are hollow and are supported at their opposite ends by the heater end walls 28, 30. FIG. 6 illustrates the mounting arrangement at the rear end wall 30 for the typical beam 44. The beam passes through an oval opening 70 formed in the end wall and is attached by welding or bolting to a vertical support column 72. An opening formed through the support column carries a fitting 74 for directing a stream of cooling air into the inner volume of the beam to prevent overheating of the beam when the burner segments are removed in a manner described hereafter. An inactive rear extension section 76 (FIG. 2) of oval cross section is mounted about the end of the beam and closely fitted through opening 70 of the rear end wall. Six of the burner segments are then slipped one-by-one on the opposite end of the beam and secured together in tandem by truss rods mounted through bolt holes 78 in the end flanges. Suitable high temperature compressible gaskets are fitted between the end flanges of adjacent segments to prevent gas mixing between the plena and leakage into the heater chamber. The burner segments are moved in steps along the beam to the operating position shown in FIG. 2. A pair of guides 80, 82 extend downwardly from the upper baffle 56 (FIG. 5) to guide and position the burner segments over the beams. An inactive forward extension section 84 is then mounted on the beam to abut the last burner segment, and this extension section is closely fitted through an opening 86 formed in the front end wall in the manner shown in FIG. 7.

Gas seals are formed between the ends of the burner units and the openings in the heater end walls. High-temperature RTV rubber caulking is placed around the tightly-fitting juncture between rear extension section 76 and the opening 70 in the rear end wall. The end of the rear extension is sealed off by bolting and sealing it to upright channel 72 which supports the beams. The forward end of the burner unit rests on a sliding support, not shown, and extends through the opening 86 in the forward end wall 28 to allow for thermal expansion of both the beam and burner unit during operation.

Figure 7:
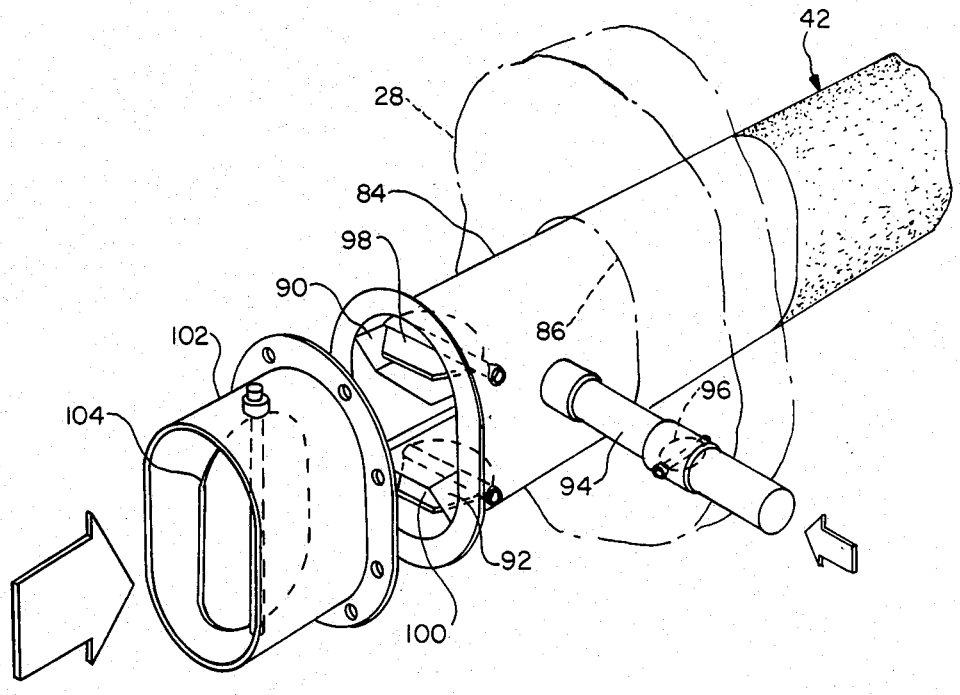
FIG. 7 is a perspective view showing the inlet control arrangement for one of the burner units shown in FIGS. 1–3.

The fuel/air distribution and control means for a typical one of the burner units is illustrated in FIG. 7 and includes a pair of baffles 90, 92 which are mounted longitudinally within extension section 84. The baffles divide the inner volume of that section into a middle plenum which connects with the main fuel/air plenum 58 of the front end burner segment, and top and bottom plena which connect with the respective top and bottom plena 60, 62 of the same front end burner segment. An inlet conduit 94 leading from main fuel gas supply line 95 (FIG. 1) is connected through an opening in the side of extension section 84 with the middle plenum. A butterfly control valve 96 is mounted in the outlet conduit to control the flow of inlet gas. Within each of the top and bottom plena of the extension sections butterfly flow control valves 98, 100 are provided to control the rate of gas flow through those plena. A branch conduit 102 fitted with a main air butterfly control valve 104 is mounted by a flange to the end of extension section 84.

As shown in FIG. 1 duplex combustion air fans 106, 108 are provided to direct pressurized air upwardly into a manifold 110 which leads out horizontally through branch conduits 102 into the individual burner units. The main flow of air from the branch conduits leads past the main butterfly valve and enters extension section 84 where it is divided by the baffles into three streams. The rate of air stream in the upper and lower plena is controlled by the setting of the butterfly valves 98, 100, and the streams are directed serially along the top and bottom plena of the burner segments. The air stream passing through the middle plena mixes with the fuel gas entering from conduit 94. A suitable control system, not shown, is employed to coordinate gas valve 96 and air valve 104 for controlling the main air/fuel flow rate and thereby controlling the burner firing rate. Where it is desired to bleed fuel gas into the air streams leading to the less active sections of the burners, additional gas lines and control valves, not shown, are connected into the upper and lower plena of extension section 84.

The present invention provides the capability of removal of one or more selected burner units for purposes of repair of replacement while the remaining burners remain in operation. This is accomplished by first detaching the air and fuel connections for the desired burner unit. While supporting the outboard end of beam 44 the burner unit is pulled out to the point at which forward extension section 84 can be unbolted. The support for the beam is then shifted to a point just inboard of the extension section, which is then removed from the beam. The beam support is then shifted back to the outboard end, the burner advanced out one more step to the point at which the first burner segment is then unbolted, and the beam support shifted inboard of the latter segment, which is then removed from the beam. These steps are repeated until all burner segments are removed. While the burner segments are being removed from the beam cooling air is injected through inlet 74 (FIG. 5) at the opposite end of the beam. The flow of this air through the beam cools the beam sufficiently to prevent overheating due to the high temperature of the heater environment, on the order of 1400° F.

One example of the use and operation of the invention is as follows. An existing process heater of the conventional box type is retrofitted in accordance with the embodiment of FIGS. 1-7. The existing conventional flame burners of the heater are removed along with sections of the end walls. New runs 105 and 105' of radiant tubes are installed at the lower ends of the existing radiant tube coils. Ten of the burner units 40 are mounted on support beams 44 vertically in a tier between the radiant tube coils. The burner units 40 are comprised of six burner segments 42 each having a length of 48" and an oval cross section with a height of 15" and a width of 8". The combustion air fans 108 and 108 together with manifold 110 are erected and connected by the fuel/air distribution and control means with the burner units. The fuel gas piping and control equipment are then installed.

After the retrofit installation is completed the burners are operated using premixed air and natural gas as the fuel. The active surface zones A and B of each segment generate a combined heat input of 870 MBtu/hr at a specific heat input rate of 100 MBtu/hr-ft$^2$ of burner area. Each burner unit therefore provides 5.2 MMBtu/hr of heat input and with all ten burner units operating at full capacity the heater will provide 52 MMBtu/hr heat input for the process heater.

During operation butterfly valves 98 and 100 in the forward extension section are controlled to direct a reduced flow of fuel/air mixture, preferably at a rate which establishes combustion activity of the less active zone at from 5%-20% of the active zones, along the upper and lower plena 60 and 62 of the burner segments. The corresponding surface zones C and D are thereby rendered less active so that the opposing top and bottom sides of adjacent burners do not overheat. Alternatively, streams of air without fuel are directed into the upper and lower plena to render the surface zones C and D combustibly inactive.

On the active burner surfaces the fuel/air mixture flamelessly combusts and generates an incandescent, hot surface. These surfaces transfer the burner's heat output primarily by radiation to the opposing heat sink comprised of the radiant tube coils 14, 16. The exhaust gases flow upwardly in a stream past the tube coils 20, 22 in the convective section, which absorb a substantial portion of the residual heat, and thence upwardly through the exhaust flue 36.

The burner units of the invention are characterized in that there is no discontinuity in the fiber matrix layer between the active and inactive surface zones, as would be the case where the active fiber matrix layers are separated by metal or ceramic insulation barriers as in the case of flat plate burners of conventional design. The continuity of the fiber layer about the oval circumference of the burner in this invention obviates the problem of crack formation which would otherwise occur at the boundary between the active and inactive surface zones. This novel configuration of the invention also eliminates the requirement for edge sealing at the boundary between the zones, which would otherwise be required to seal junctures between dissimilar materials, such as between the fiber layers and metal or rigid ceramic insulation as in flat plate burners.

Figure 8:
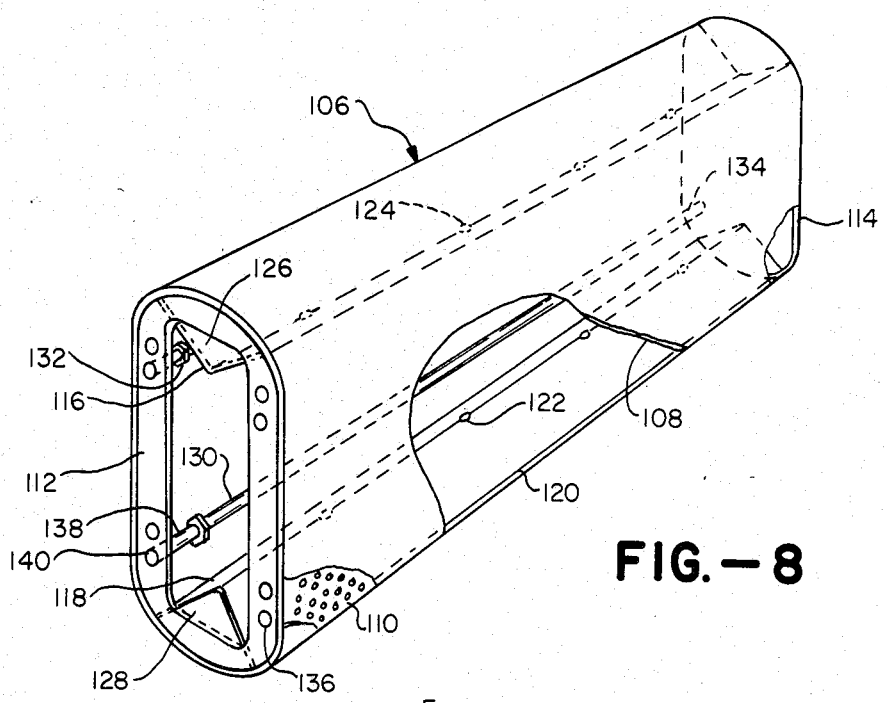
FIG. 8 is a perspective view, partially broken-away, of a zone-controlled radiant burner segment according to another embodiment of the invention.
Figure 9:
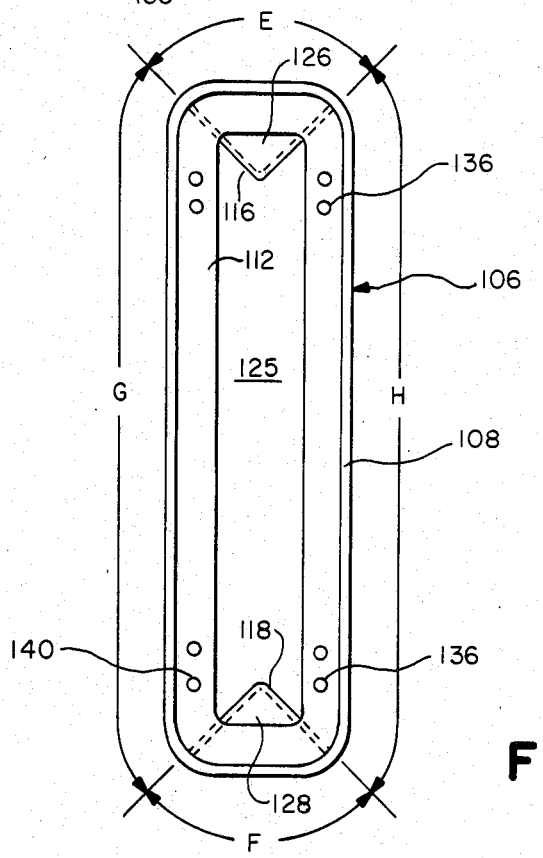
FIG. 9 is a cross sectional view to an enlarged scale of the burner segment of FIG. 8.

FIGS. 8 and 9 illustrate an embodiment of the invention comprising a zone-controlled radiant burner segment 106 providing another system for bleeding fuel/air mixture at a controlled and reduced flow rate into the plena for the less active surface zones. A plurality of the burner segments 106 are assembled in tandem to form the individual burner units for use in the retrofitted heaters of the present invention.

The typical burner segment 106 is comprised of a fiber matrix shell 108 of elongate, oval cylindrical shape supported about a perforate screen 110 which in turn is mounted between a pair of end flanges 112, 114. The burner shell is comprised of the porous layer of ceramic fibers described above for the embodiment of FIGS. 1-7. Longitudinally extending V-shaped divider plates 116, 118 are mounted at the top and bottom sides within the inner volume of the burner segment. The side edges 120 of the divider plates are secured as by welding to the perforate screen. A plurality, shown as four, of orifices 122, 124 are formed at equally-spaced intervals along the bight edges of both divider plates. The number of orifices for each divider plate, and the orifice diameters, will depend on the desired rate at which fuel/air mixture is to bleed into the small plena for a particular application in order to achieve combustion activity on the less active surface zones shown by arcs E and F in the range of 5%-20% of the active surface zones shown by arcs G and H. In the configuration illustrated in FIGS. 8 and 9 the size of the orifices 122 advantageously can be in the range of ⅛" to ⅝" diameter. Triangular-shaped end plates 126, 128 conforming with the cross section of the dividers are secured at opposite ends of the dividers to seal the ends of the upper and lower plena.

The burner segments are mounted in end-to-end relationship by four truss rods 130, 132 mounted internally in each segment. The end 134 of each truss rod which is remote from the side from which installation is being made (the left side as viewed in FIG. 8) is threaded through one of the openings 136 formed in the right-hand flange, and the end of this rod projects through and is threadably engaged with an aligned opening formed in the end flange on the left side of the next adjacent burner segment. The left-hand side 138 of the truss rod (as viewed in FIG. 8) is freely seated within, and flush with, a corresponding opening 140 formed in the left-hand flange of the segment. This left-hand end of the truss rod is slotted for engagement with a screwdriver or other tool used for mounting and dismounting the truss rods.

In operation of a burner unit assembled with the segments of FIGS. 8 and 9 only a single stream of fuel/air mixture is directed from the manifold into the middle plena 125 of each burner unit. From the middle plena the fuel/air mixture flows in separate low flow rate streams through the orifices 122, 124 of the divider plates into the upper and lower plena. From the upper and lower plena the mixture flows outwardly through the fiber matrix layer along the less active surface zones E and F at a flow rate in the range of 5%–20% of the flow rate of mixture from the middle plena which flows through the side walls of the segments and incandescently combusts along the active surface zones G and H.

The invention also contemplates the provision of orifices, not shown, formed in each of the triangular-shaped plates 126, 128 at the opposite ends of the divider plates, and in such case the orifices along the edges of the divider plates would be eliminated. The orifices in the triangular-shaped end plates would be in axial alignment and preferably would be sized on the order of ½" to ¾" diameter to establish the desired low flow rates through the plena.

Figure 10:
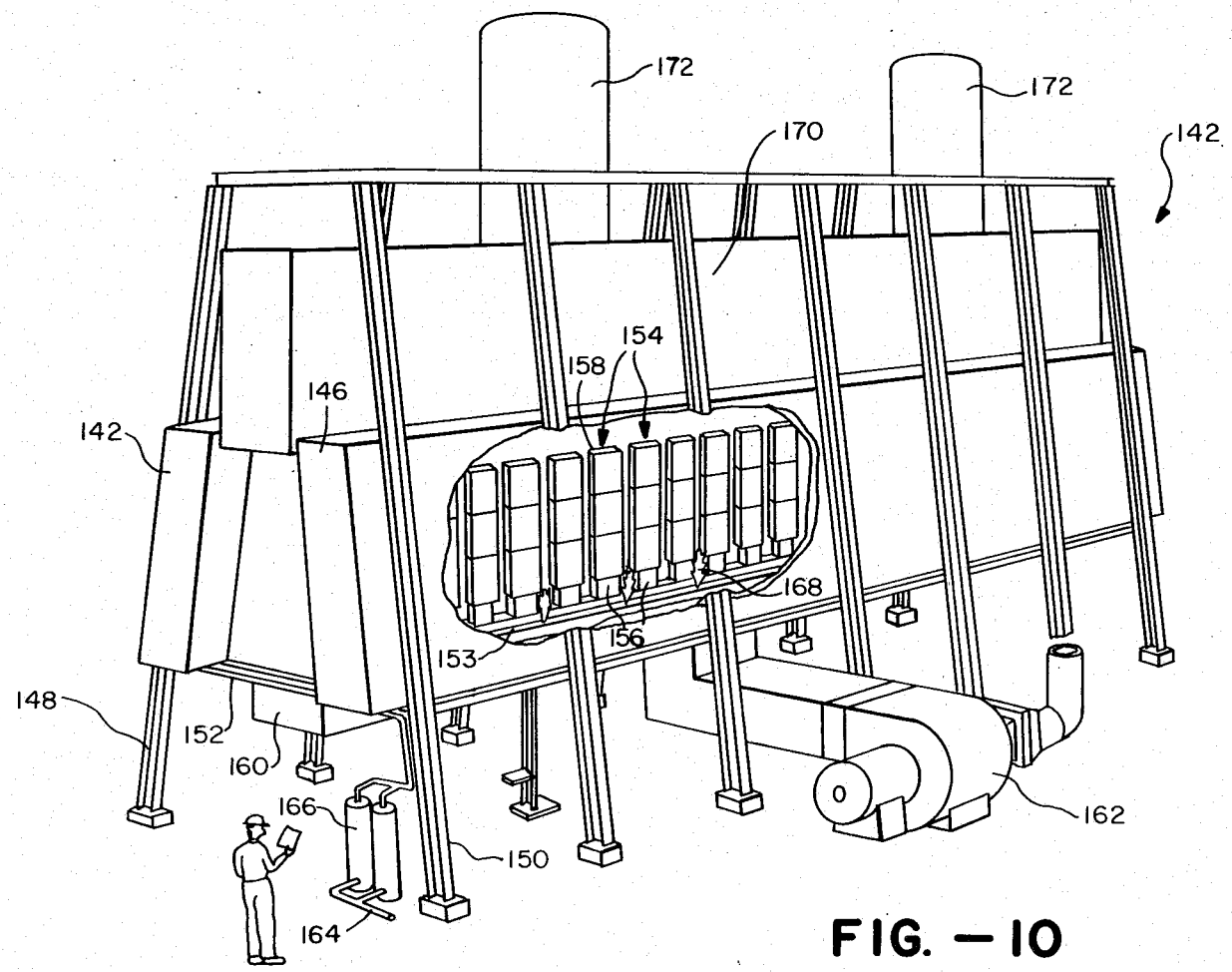
FIG. 10 is a perspective view, partially broken-away, of a process heater which has been retrofitted in accordance with the invention.

FIG. 10 illustrates another embodiment illustrating use of the invention in the retrofit of a heater 142 of a single firebox design. Prior to retrofit installation of the invention the heater was of the type commonly known as the A-frame design. In this type of heater radiant coils, not shown, are carried within housings 144, 146 which are supported at an upwardly converging angle by columns 148, 150. Supported flame burners which would have been mounted within the floor 152 of the heater would heat the inside surfaces of the radiant tube coils. In the retrofitting of this conventional heater, the supported flame burners are removed and an access slot 153 is formed along the floor of the heater. A plurality of burner segments 154 constructed in accordance with the segments described in connection with FIGS. 4 and 5, or in accordance with the segments described in connection with FIGS. 8 and 9, are assembled together in tandem, and in the embodiment illustrated for FIG. 10 each burner unit is set with its longitudinal axis extending vertical. An inactive end segment 156 provided with a suitable mounting flange is attached to the end of the lowermost segment. Each burner unit is inserted upwardly through access slot 153 and is secured by bolting the flange of the inactive segment to the edges of the access slot. The oval burner segments are installed with their flat surfaces facing the radiant coils, and their side edges are rendered either inactive or less active in a manner described above in connection with FIGS. 4–7 or FIGS. 8–9. The top end of the uppermost segment of each burner is also rendered inactive by means of an imperforate end plate 158.

Completion of the retrofit installation for FIG. 10 includes mounting a manifold 160 beneath the access slot of the floor with a combustion air blower 162 connected with the manifold. Gas piping 164 and filters 166 together with suitable gas control valves, not shown, are installed to inject the fuel into the flow of combustion air leading into the burners. Pilot flames 168 ar mounted along the floor within the heater to ignite the burners. The active surface zones of the burners incandescently combust to heat the radiant section tube coils, with exhaust gases flowing upwardly to the convective coils, not shown, within housing 170 and thence outwardly through vents 172.

Figure 11:
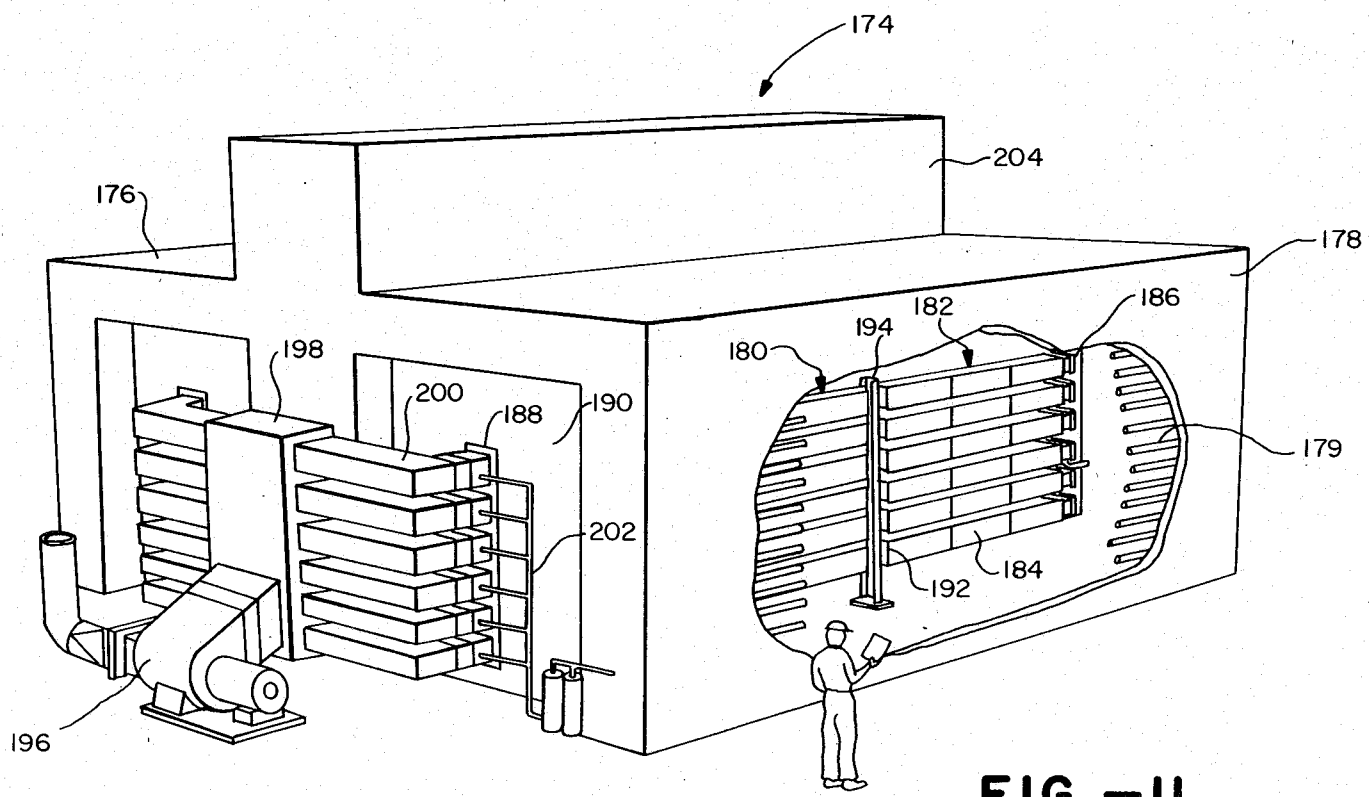
FIG. 11 is a perspective view, partially broken-away, of another embodiment comprising a process heater which has been retrofitted in accordance with the invention.

FIG. 11 illustrates another embodiment in which the invention is incorporated in retrofitting a dual firebox heater 174. Prior to the retrofit, the heater comprises a pair of radiant section chambers 176, 178, each containing radiant tube coils 179 and end wall-mounted supported flame burners. This conventional dual-firebox heater is retrofitted by removing the supported flame burners and installing in each chamber tiers of horizontally extending burner units 180, 182 of the type described in connection with FIGS. 1–7 of this invention. As illustrated in the cutaway section of chamber 178 in FIG. 11, six burner units 184 are mounted in vertically-spaced relationship in each of two tiers. The tiers are mounted in end-to-end relationship with inactive extension sections 186 at the inlet ends of the burner units extending through access openings 188 which are formed in the opposite end walls 190 of the heater chamber. In each tier the burner units are carried on horizontally extending support beams of the type shown in FIG. 5. The proximal ends 192 of each of the beams are supported on the chamber end walls, and the distal ends of the unit are provided with support pins, not shown. The support pins are slidably carried in slots formed in a vertical post 194 mounted at the center of the chamber. This sliding support accommodates thermal expansion and contraction of the burner units. The oval burners are mounted with their combustibly active flat sides oriented vertical and with their top and bottom sides rendered inactive or less active in the manner described above in connection with FIGS. 4–7 or FIGS. 8–9.

The retrofit of the embodiment of FIG. 11 further includes installation of a pair of combustion air blowers 196, one for each end of the heater. Combustion air from the blower shown for the left-hand side of the heater of FIG. 11 directs air into a central manifold 198 and thence through branch conduits 200 to the inlet ends of individual burner units. Gas piping 202 and suitable gas control valves, not shown, are installed to connect into the branch conduits for mixing the fuel and air leading to the burners. Suitable pilot flames are installed within the chambers to ignite the mixture on the burner surfaces which incandescently combust and heat the radiant tube coils. Exhaust from the burners flows in heat exchange relationship with convective coils, not shown, within upper section 204, and thence through exhaust vents, not shown.

Figure 13:
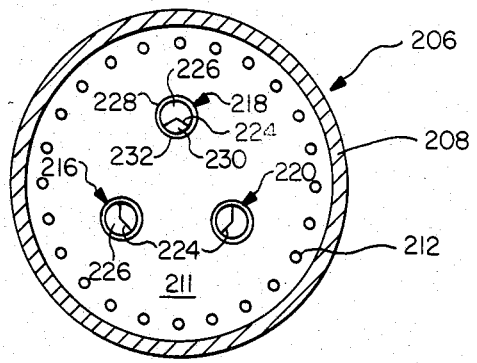
FIG. 13 is a horizontal cross sectional view taken along the line 13—13 of FIG. 12.
Figure 12:
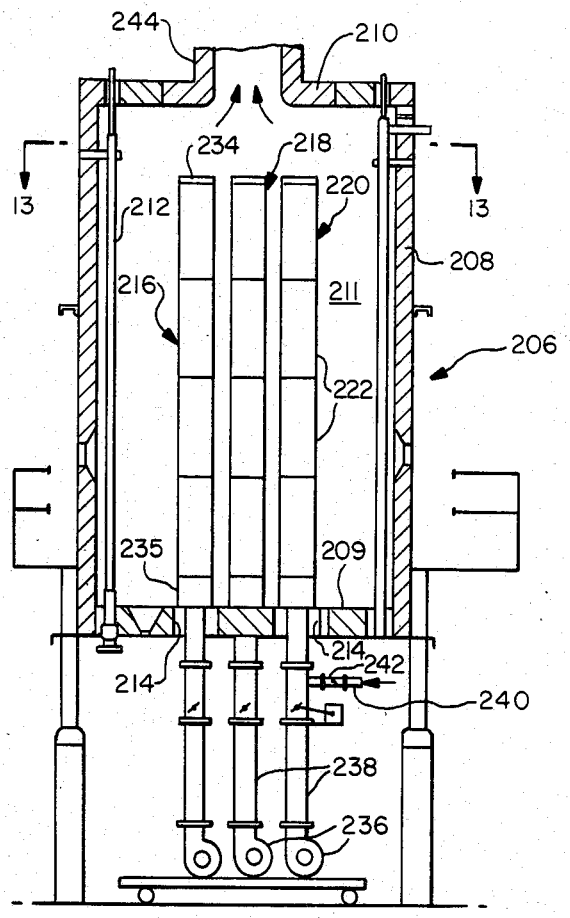
FIG. 12 is a vertical cross sectional view of still another embodiment comprising a process heater which has been retrofitted in accordance with the invention.

FIGS. 12 and 13 illustrate another embodiment in which the invention is employed in retrofitting a vertical cylindrical heater 206. Prior to retrofit the conventional cylindrical heater includes a cylindrical wall 208, lower floor 209 and roof 210 which define a combustion chamber 211. In the conventional heater supported flame burners are carried on the lower floor for heating a vertical setting of radiant coils 212 which are mounted within the combustion chamber in a circular tier about the inside of the cylindrical wall. The retrofitting procedure includes the step of removing the supported flame burners and enlarging the burner ports 214 in floor 209. A plurality of vertically extending burner units are installed through the burner ports, and in the illustrated embodiment three burner units 216, 218 and 220 are set at 120° angular relationship about a circle spaced radially inwardly from the radiant coils.

Each burner unit 216–220 is comprised of a plurality, shown as four, of burner segments 222 mounted in tandem. The burner segments are constructed in accordance with the embodiments described in connection with FIGS. 4–7 or FIGS. 8 and 9 but with the burner shells of circular cross section and with elongate V-shaped baffles 224 mounted lengthwise within ' each segment. The baffles divide the inner volume of each segment into a main plena 226 feeding fuel-air mixture to an active surface zone 228 and a smaller plena 230 for a reduced flow of fuel-air mixture, or only air, feeding the less active or inactive surface zone 232. To protect the facing burner surfaces from overheating the surface zones 232 have areas of approximately $\frac{1}{3}$ the total burner surface area with the remaining $\frac{2}{3}$ surface area comprising the active zone 232. This area ratio is achieved by forming the baffles 224 with included angles of 120°. The upper end of the distal burner segment of each unit is closed by an inactive end cap 234. An inactive end segment 235 is mounted at the lower end of each burner unit and fits through burner port 214. A mounting flange attached to the inactive segment is bolted to the floor to provide vertical support for the unit.

Retrofit installation of heater 206 further includes mounting combustion air blowers 236 which are connected with manifolds 238 leading upwardly into respective burner units. Gas piping 240 and suitable gas control valves 242 are installed to inject fuel for mixture with the combustion air directed into each of the burners. Pilot flames, not shown, are mounted in floor 209 to ignite the mixture on the burner surfaces, which incandescently combust to heat radiant coils 212. Exhaust gases flow upwardly through a vent 244 in the roof. As required the exhaust gases can be routed in heat exchange relationship with a suitable convective coil, not shown.

With the invention the high heat capacity of the fiber matrix burners in comparison to the supported flame burners of conventional heaters permits the retrofit installation to include adding tube area to the radiant coil and thereby increases process fluid capacity. The more uniform heat flux, and absence of flame impingement, provided by the fiber matrix burners also reduces the risk of coking and burnout of the radiant section tubes.

The fiber matrix burners of the invention are characterized in having a low conductivity of the fibers which, coupled with the conductive cooling from the incoming flow of reactants, allows the burners to operate safely without flashback. The burner units are also quieter in operation in that they produce none of the aerodynamic combustion noise associated with burners having supported flames. The burners of the invention furthermore turn on and off instantly from a pilot flame, and are not susceptible to thermal shock. The burners also operate at very low excess air levels and with low pressure drop. Due to the low combustion temperatures of the fiber layers, which suppresses thermal $NO_x$ formation, the burners will emit less than 15 ppm $NO_x$ and low CO and hydrocarbon emissions. In addition, $NO_x$ emission levels are not dependent on the environment, such as the heat sink temperature, into which the burner is radiating. This eliminates the need for post-combustion clean up apparatus.

The heat input of the burner segments is a function of the active surface area so that the burner units can be scaled to the desired heat input requirements. In addition, the number of burner segments assembled to form a burner unit, and the number of burner units in a tier, can be varied according to the requirements of a particular application.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. A radiant burner for use in a process heater, the burner comprising the combination of a fiber matrix shell of elongate cylindrical shape, the matrix having interstitial spaces between the fibers for diffusing fuel and air therethrough, baffle means for dividing the internal shell volume into a plurality of separate plena which extend lengthwise of the shell, inlet means for directing independent streams of gas into the separate plena, with a first one of the plena receiving a first stream comprising a fuel and air mixture which flows through the fiber matrix and flamelessly combusts on the outer surface portion of the shell which surrounds the first plenum forming an active combustion zone to transfer heat outwardly primarily by radiation, and zone control means for directing into at least a second one of the plena a second gas stream which is comprised substantially of air or a mixture of fuel and air at a flow rate less than the flow rate of the first stream, said second stream flowing through the fiber matrix so that the outer surface portion of the shell which surrounds the second plenum forms a combustibly inactive or less active zone.

2. A radiant burner as in claim 1 in which the cylinder is formed with an oval cross-section having a pair of substantially flat side walls joined by arcuate end walls with the flat side surrounding the first plenum forming the active zones which have optimum radiant view factors and with at least one of the end walls surrounding the second plenum forming the combustibly inactive or less active zone.

3. A radiant burner as in claim 2 in which the baffle means divides the internal shell volume into a third plenum with the other end wall of the cylinder surrounding the third plenum, and said zone control means includes means for directing into the third plenum another gas stream comprised substantially of air or a mixture of fuel and air at a flow rate less than the flow rate of the first stream.

4. A radiant burner as in claim 1 in which the fiber matrix shell is comprised of a plurality of segments disposed in tandem to form the cylindrical shape, each segment comprising a perforate support upon which the fiber matrix material is carried and a pair of end plates mounted at opposite ends of the support, and means for securing the end plate of one segment to the facing end plate of an adjacent segment to form a rigid cylindrical shape.

5. A radiant burner as in claim 4 in which the baffle means comprises at least one plate extending lengthwise within each segment between that segment's end plates to divide the internal volume of the segment into the separate plena, and means forming ports in the end plates for directing the first and second streams between the respective plena of adjacent segments.

6. A radiant burner as in claim 4 which includes an elongate beam extending through the internal volume of the segments for supporting the segments.

7. A radiant burner as in claim 1 in which the zone control means comprises orifice means formed in the baffle means for bleeding into the second plenum the second gas stream comprising a fuel and air mixture from the first plenum.

8. A radiant burner as in claim 1 in which the baffle means comprises at least one imperforate baffle plate extending lengthwise of the shell to divide the internal volume thereof into the first and second plena, end plate means at opposite ends of the baffle plate to form seals preventing gas mixing between the plena, and orifice means formed in the end plate means of each segment in alignment with orifice means of adjacent segments with the orifice means controlling the second gas stream at the flow rate which is in the range of substantially 5%–20% of the flow rate of the first stream.

9. A radiant burner as in claim 1 in which the shell extends continuously about the baffle means without separation in the fiber matrix material at the juncture between the zones.

10. A process heater comprising the combination of a radiant section chamber, a plurality of elongate fiber matrix burners mounted in spaced-apart relationship in at least one tier within the chamber, radiant tube coils spaced from the tier of burners, each burner comprising a hollow cylindrical shell formed of a fiber matrix material having interstitial spaces between the fibers for passing a fuel and air mixture through the matrix for flamelessly combusting on the outer surface of the shells with heat transferring primarily by radiation to the opposing tube coils, each burner including additional means for dividing the internal shell volume into at least first and second plena which extend lengthwise of the shell, and zone control means for directing into the first plenum a first stream of the fuel and air mixture whereby active combustion takes place on the active zone of the shell surrounding the first plenum, the zone control means further directing into the second plenum a second stream comprised substantially of air or a mixture of fuel and air which flows at a rate less than the mixture of the first stream whereby the zone of the shell surrounding the second plenum is combustibly inactive or less active in relation to the active zone to minimize overheating of the burner shell.

11. A process heater as in claim 10 in which the shells forming the burners are of substantially oval cross section with the shell having substantially flat sides joined by arcuate end walls and with the flat sides surrounding the first plenum to form the active zones having optimum radiant view factors with respect to the opposing radiant section tube coils.

12. A process heater as in claim 11 in which the additional means includes a pair of baffles which divide the internal shell volume into at least a second plenum disposed on a side of the first plenum, and the zone control means directs into the second plenum a stream which is comprised substantially of air or a mixture of fuel and air.

13. A process heater as in claim 10 in which the zone control means comprises means forming orifices in the additional means for bleeding fuel and air mixture from the first plenum into the second plenum to form the second stream.

14. A process heater as in claim 10 which includes a plurality of elongate, horizontally extending beams mounted in vertically spaced relationship in the heater with each beam extending through the inner volume of a respective burner shell for supporting the burners horizontally in the tier.

15. A process heater as in claim 14 in which the shell of each burner is comprised of a plurality of segments, and mounting means for detachably mounting the segments of each burner in tandem along a respective beam.

16. A process heater as in claim 15 in which the mounting means includes means for detaching the segments of a selected burner and removing such segments from the heater during continued operation of the remaining burners.

17. A process heater as in claim 16 in which the beams are hollow, and including means for directing a stream of cooling air along the inner volume of a beam when the burner segments associated with that beam are removed from the heater.

18. A process heater as in claim 10 which includes first support means for supporting the proximal end of each burner unit, and second support means for slidably supporting the distal end of each burner unit to accommodate thermal contraction and expansion thereof.

19. A process heater as in claim 10 which includes support means for supporting the proximal end of each burner unit on the floor of the heater with the units extending upright in laterally spaced-apart relationship in the tier.

20. A process heater as in claim 10 in which the heater includes a vertically axised hollow cylinder having a floor with the radiant section tube coils mounted about the inner circumference of the cylinder, and support means for supporting the proximal end of each burner unit on the floor with the units vertically oriented in laterally spaced-apart relationship in a circular tier spaced radially inwardly from the tube coils.

21. A combustion process for a radiant burner having a fiber matrix layer in a cylindrical shell configuration enclosing an inner volume, including the steps of directing a first stream of a predetermined mixture of fuel and air out through the fiber matrix layer along a first surface zone of the shell, directing a second stream of a gas out through the layer along a second surface zone which is separate from the first zone, flamelessly combusting the mixture of the first stream along the outer surface of the first zone to transfer heat outwardly therefrom primarily by radiation, said gas of the second stream at the second surface zone being combustibly inactive or combustibly less active than said mixture at the first zone whereby the gas at the second zone does not combust or combusts at a rate which develops insufficient temperature to overheat the burner surface.

22. A combustion process as in claim 21 in which the gas in the second stream consists of air whereby the second surface zone is combustibly inactive, and the second stream is directed along a path through the inner volume separate from the first stream.

23. A combustion process as in claim 21 in which the first stream is controlled to flow at a predetermined rate through the layer of the first surface zone, and the second stream comprises a mixture of fuel and air which is controlled to flow through the layer of the second surface zone at a rate which is in the range of substantially 5%–20% of the rate of the first stream.

24. A combustion process as in claim 21 in which the gas of the second stream comprises a mixture of fuel and air which is bled from the mixture of the first stream.

25. A combustion process as in claim 21 in which the gas of the second stream comprises a mixture of fuel and air which is directed along a path through the inner volume separate from the first stream.

* * * * *